US005857737A

United States Patent [19]

Fraser

[11] Patent Number: 5,857,737

[45] Date of Patent: Jan. 12, 1999

[54] CLAMP

[75] Inventor: Ian Fraser, Codicote, England

[73] Assignee: HMC-Brauer Limited, United Kingdom

[21] Appl. No.: 790,160

[22] Filed: Jan. 28, 1997

[51] Int. Cl.[6] ..... B25B 1/08

[52] U.S. Cl. ..... 269/236

[58] Field of Search ..... 269/235, 236, 269/229, 228, 282, 60; 254/DIG. 3

[56] References Cited

U.S. PATENT DOCUMENTS

| | | | |
|---|---|---|---|
| 414,669 | 11/1889 | Baldwin | 269/236 |
| 1,503,087 | 7/1924 | Brown | 254/DIG. 3 |
| 2,194,138 | 3/1940 | Crawford | 269/236 |
| 3,237,463 | 3/1966 | McPherson | 269/228 |
| 3,819,171 | 6/1974 | Sendoykas et al. | 269/228 |
| 4,167,865 | 9/1979 | Powell | 269/228 |
| 4,335,873 | 6/1982 | Kiefer | 269/228 |

FOREIGN PATENT DOCUMENTS

| | | |
|---|---|---|
| 24890/67 | 1/1970 | Australia . |
| 385287 | of 1931 | United Kingdom . |
| 744064 | 2/1956 | United Kingdom . |
| 932218 | 7/1963 | United Kingdom . |
| 952112 | 3/1964 | United Kingdom . |
| 1559876 | 1/1980 | United Kingdom . |

OTHER PUBLICATIONS

Data Sheet 2331—Halder norm+technik—Down–thrust Clamps HWN 331 (Jun. 1994).

*Primary Examiner*—Robert C. Watson
*Attorney, Agent, or Firm*—Leo Zucker

[57] ABSTRACT

A clamp for clamping a workpiece includes a body member having a bore with a longitudinal axis, a plunger mounted in the bore for sliding movement relative to the body member and a handle pivotally mounted on the body member and operative to drive the plunger in the direction of the longitudinal axis. The body member is mounted on a bracket for rotation relative thereto about the longitudinal axis.

9 Claims, 4 Drawing Sheets

CLAMP

BACKGROUND OF THE INVENTION

1. Field of the Invention

The present invention relates to a clamp. In particular, but not exclusively, the invention relates to a clamp for exerting a pushing force on a workpiece.

2. Discussion of the Known Art

An example of a clamp for exerting a pushing force on a workpiece is that sold by Halder Norm+Technik under the model number 2323. This clamp has a clamping lever with a spiral eccentric that engages one end of a plunger. The plunger is provided at its other end with a workpiece-engaging jaw. Swinging the lever through an arc of approximately 180° drives the plunger in the direction of its longitudinal axis, so clamping the workpiece.

A disadvantage of the clamp described above is that because the position of the clamping lever cannot be adjusted, As can sometimes obstruct operation of a machine tool on which the clamp is mounted, particularly if the clamp is not fully applied. Also, in certain applications, the camping lever may be rather awkwardly placed for convenient use.

A further disadvantage is that travel of the plunger is relatively small, with the result that it can become necessary to reposition the clamp for each workpiece, if the dimensions of the workpieces vary significantly. This is inefficient and time consuming.

SUMMARY OF THE INVENTION

It is an aim of the present invention to provide a clamp that mitigates at least some of the above-mentioned disadvantages.

According to the present invention there is provided a clamp for clamping a workpiece, the clamp comprising a body member including a bore having a longitudinal axis, a plunger mounted in the bore for sliding movement relative to the body member in the direction of the longitudinal axis, and a handle pivotally mounted on the body member and operable to drive the plunger in the direction of the longitudinal axis, the body member including mounting means arranged to allow rotation of the body member about the longitudinal axis.

Because the body member can be rotated, it is possible to position the handle so that it does not cause an obstruction and so that it may be operated conveniently.

The mounting means may be arranged to allow linear movement of the body member in the direction of the longitudinal axis, so allowing the position of the clamp to be adjusted or workpieces of different sizes.

The body member may be mounted on a base member for rotation relative thereto. The body member and the base member may have cooperating screw threads. This allows the longitudinal position of the clamp to be adjusted at the same time as the position of the handle, thereby accommodating variations in the dimensions of the workpieces. Alternatively, the clamp may be mounted to a fixture by means of a mounting hole.

The clamp may include means for preventing rotation of the body member. This may consist of one or more lock nuts provided on a threaded portion of the body member.

Advantageously, the handle includes a cam surface that engages the plunger. The cam surface preferably has at least two portions of different pitch to provide a fast initial travel and a slower clamping travel. The cam surface may be in the form of an spiral eccentric cam.

The clamp may include resilient means arranged to oppose movement of the plunger in a first direction, thereby causing the plunger to retreat from the workpiece when the clamp is released.

The plunger may include an adjustable work engaging member, to accommodate large variations in the dimensions of the workpieces.

The handle may include a removable extension, to allow a large clamping force to be applied without obstructing operation of the machine tool.

The base member and the handle may comprise metal castings.

Embodiments of the invention will now be described, by way of example, with reference to the accompanying drawings, and the appended claims.

DETAILED DESCRIPTION OF THE INVENTION

Figure 3:
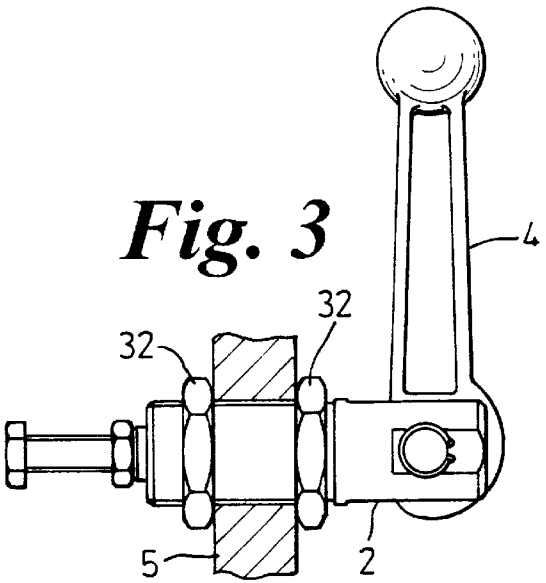
FIG. 3 is a side view so the clamp, showing an alternative mounting method.

As shown in FIGS. 1, 2 and 4 to 6, a clamp according to the invention comprises a mounting bracket 1, a body 2, a plunger 3 and a handle 4. An alternative form of the clamp, which is mounted in a hole in a fixture 5 and omits the mounting bracket 1, is shown in FIG. 3.

Figure 7:
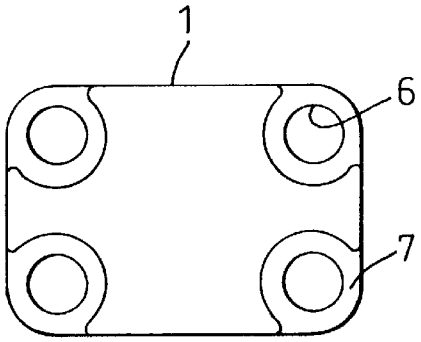
FIG. 7 is a top view of a mounting bracket.
Figure 8:
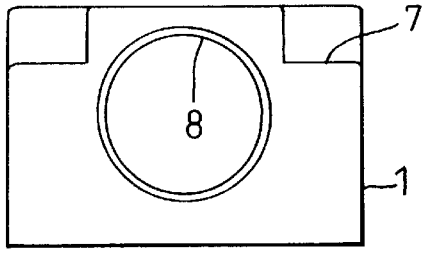
FIG. 8 is a rear view of the mounting bracket.
Figure 9:
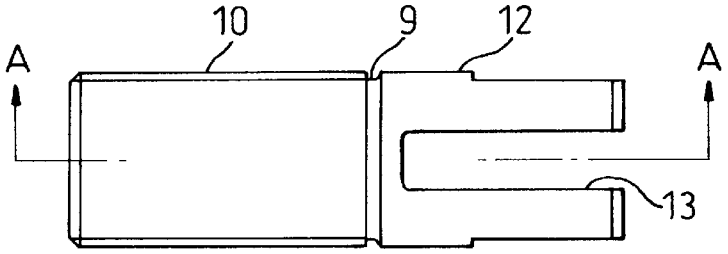
FIG. 9 is a top view of a body.
Figure 10:
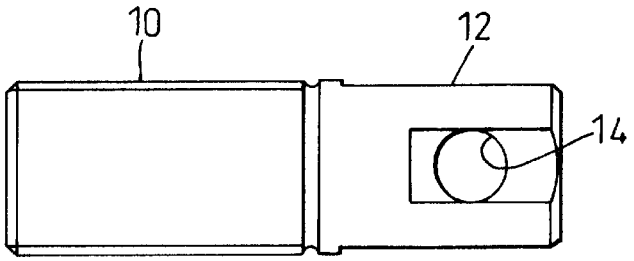
FIG. 10 is a side view of the body.
Figure 11:
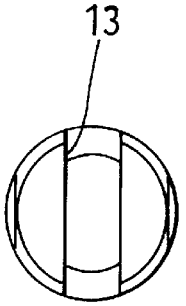
FIG. 11 is a rear view of the body.
Figure 12:
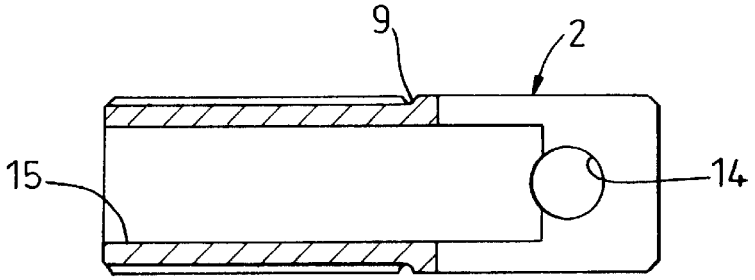
FIG. 12 is a cross-section on line A—A of FIG. 9.

The mounting bracket 1 is shown in more detail in FIGS. 7 and 8 and comprises a metal block having four holes 6 for receiving mounting bolts (not shown). Recessed portions 7 are provided in the upper face of the block at the upper ends of the holes 6, to accommodate the heads of the mounting bolts. A threaded cylindrical bore 8 extends transversely through the mounting bracket 1.

The body 2, which is shown in more detail in FIGS. 9 to 12, is substantially cylindrical and is divided by a peripheral groove 9 into a threaded first portion 10 that is a screw fit in the bore 8 and a second portion 12. The second portion 12 is divided longitudinally by a slot 13 that extends from the free end of the second portion to approximately 90% of the length of the second portion. The longitudinal axis of the body 2 lies in the plane of the slot 13. A transverse bore 14 extends through the second portion 12 substantially perpendicular to the plane of the slot 13.

A cylindrical bore 15 that is co-axial with longitudinal axis of the body 2 extends from the free end of the first portion 10 to approximately 80% of the length of the body 2. A bush 16 having a cylindrical bore 17 has an interference fit with the bore 15 and is located towards the free end of the bore (as shown in FIGS. 5 and 6).

Figure 13:
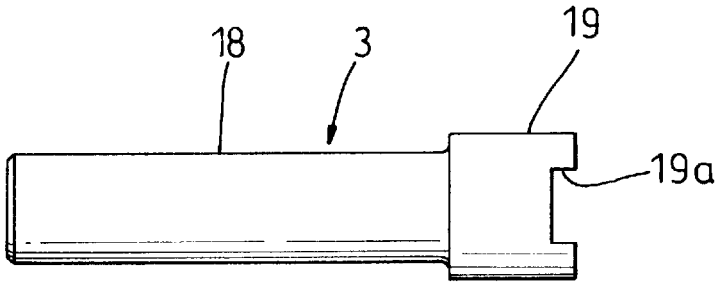
FIG. 13 is a top view of a plunger.
Figure 14:
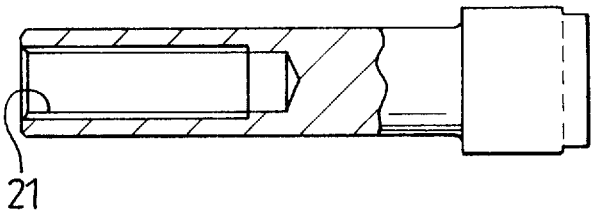
FIG. 14 is a side view, partly in cross-section, of the plunger.
Figure 15:
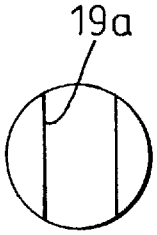
FIG. 15 is a rear view of the plunger.

The plunger 3, which is shown in more detail in FIGS. 13 to 15, comprises a cylindrical first portion 18 and a second portion 19 of larger diameter. A transverse slot 19*a* is provided in the free end of the second portion 19. A threaded cylindrical bore 21 extends co-axially from the free end of the first portion 18 to approximately 50% of the length of the plunger 3.

Figure 6:
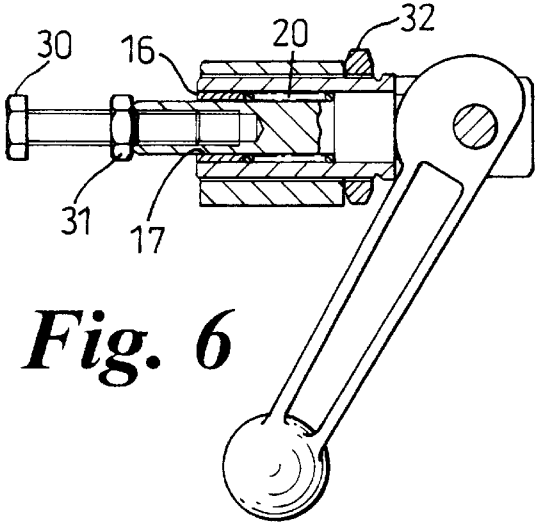
FIG. 6 is a cross-section on line A—A of FIG. 2, showing the clamp in an extended position.
Figure 2:
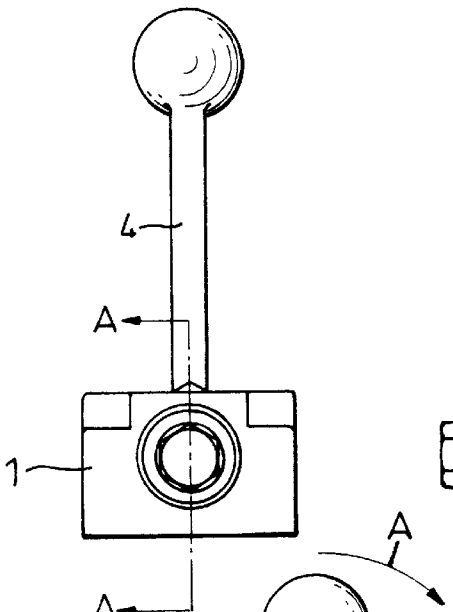
FIG. 2 is a front view of the clamp.
Figure 5:
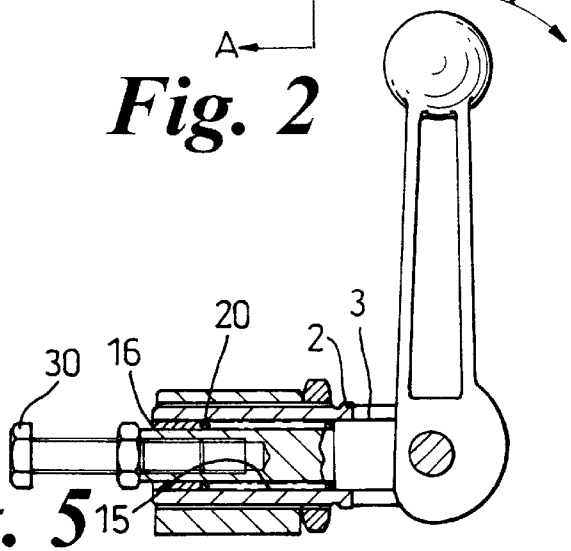
FIG. 5 is a cross-section on line A—A of FIG. 2, showing the clamp in a retracted position.
Figure 1:
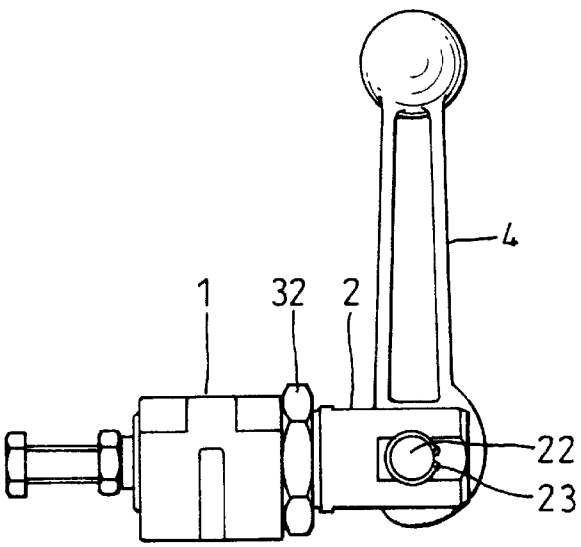
FIG. 1 is a side view of a clamp according to the invention.
Figure 4:
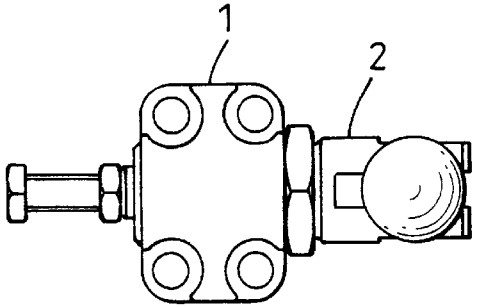
FIG. 4 is a top view of the clamp.

As shown in FIGS. 5 and 6, the plunger 3 is located in the longitudinal bore 15 of the body 2. The first portion 18 of the plunger has a sliding fit in the bore 17 of the bush 16 and the second portion 19 of the plunger 3 has a sliding fit in the bore 15 of the body 2. A compression spring 20 surrounds the first portion 18 of the plunger 3 and engages the inner faces of the bush 16 and the second portion 19 of the plunger 3. The spring 20 urges the plunger 3 and the body 2 away from one another along the longitudinal axis of the bore 15.

Figure 16:
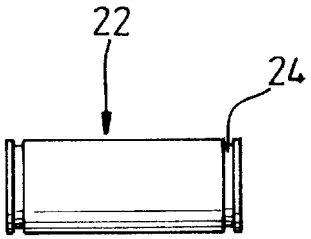
FIG. 16 is a side view of an axle.

An axle 22, shown in FIG. 16, extends through the transverse bore 14 of the body 2. The axle is retained by a pair of circlips 23 that engage peripheral grooves 24 provided at each end of the axle 22.

Figure 17:
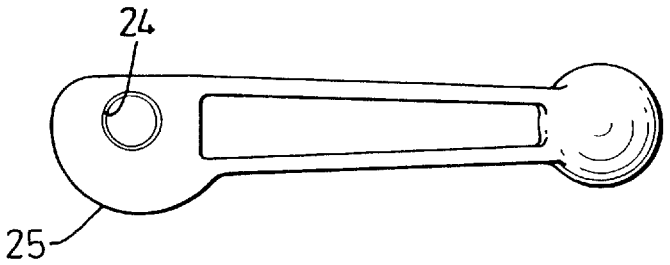
FIG. 17 is a side view of a handle.
Figure 18:
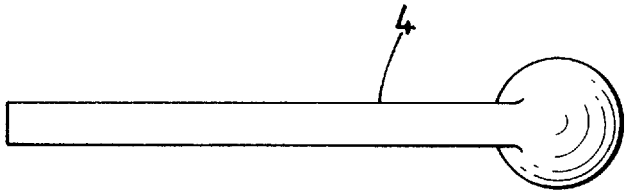
FIG. 18 is a front view of the handle.

The handle 4, which is shown in more detail in FIGS. 17 and 18, is located in the slot 13 of the body 2 and retained by the axle 22, which extends through a bore 24 in the base of the handle. The handle 4 has an eccentric (or spiral) cam surface 25 that engages the slot 19*a* in the second portion 19 of the plunger 3. The cam surface 25 has a first portion giving a fast travel and a second portion giving a slower travel and a high clamping force.

Figure 19:
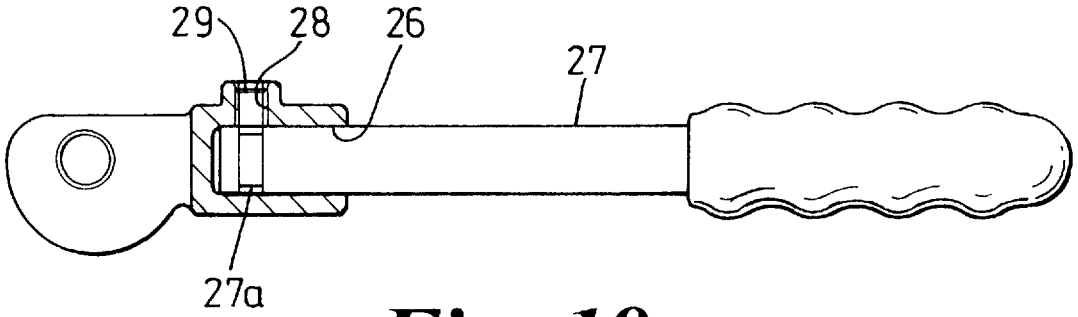
FIG. 19 is a side view, partly in cross-section, of a second form of handle.
Figure 20:
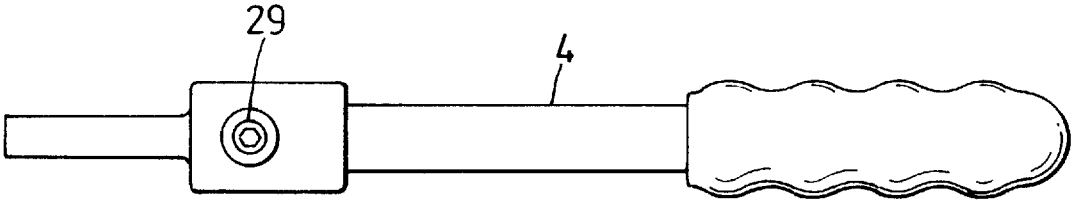
FIG. 20 is a rear view of the second form of a handle.

In an alternative form of the handle, shown in FIGS. 19 and 20, the handle 4 is provided with a socket 26 for the insertion of an extended lever 27. A threaded bore 28 extends transversely from the socket 26 and receives a grub screw 29 that engages a groove 27*a* in the lever 27 to retain the lever in the socket 26. The grub screw may alternatively be replaced by a spring-loaded detent.

A threaded set screw 30, shown in FIGS. 5 and 6, is received within the threaded bore 21 of the plunger 3. The set screw 30 is provided with a nut 31 that engages the free end of the plunger 3 to lock the set screw at the chosen position.

A lock nut 32 is provided on the threaded first portion 10 of the body 2. The lock nut 32 may be adjusted to engage an end face of the mounting bracket 1, to lock the body 2 in a chosen position relative to the mounting bracket 1. In the alternative form of the bracket shown in FIG. 3, a pair of lock nuts 32 engage opposite faces of the fixture 5. The hole in the fixture 5 may be smooth or it may be provided with a screw thread that engages the screw thread of the body 2.

when the clamp is in the retracted position as shown in FIG. 5, the plunger 3 is urged into contact with the handle 4 by the spring 20. Swinging the handle 4 in the direction of the arrow A to the position shown in FIG. 6 drives the plunger 3 in the direction of the longitudinal axis against the force of the spring 20. The first part of the movement of the handle through an arc of approximately 90° produces a fast travel of approximately 7.0 mm and the second part of the movement through an arc of approximately 120° produces a slower travel of approximately 3.0 mm and a high clamping force.

The plane of movement of the handle 4 may be adjusted by rotating the body 2 relative to the mounting bracket 1. The body 2 may be locked in the chosen position by tightening the lock nuts 32 against the end faces of the mounting bracket 1. Rotating the body 2 also produces linear movement of the body 2 in the direction of its Longitudinal axis, hereby allowing the position of the clamp to be adjusted to accommodate workpieces of different dimensions. Variations in the dimensions of the workpiece may also be accommodated by adjusting the set screw 30 and the locking nut 31.

The mounting bracket 1 and the handle 4 may be manufactured from alloy steel, for example nickel carbon steel, by investment casting (e.g. by lost wax casting). The castings may be case hardened to provide a high surface hardness for the cam and a tough core for compressive strength. The castings are finished with manganese phosphate, which provides corrosion resistance. Alternatively, the parts may be manufactured by machining.

I claim:

1. A clamp for clamping a workpiece, the clamp comprising:

a mounting bracket member including a first bore having a longitudinal axis and a screw thread on an inner circumference of the first bore;

a substantially cylindrical body member mounted in said first bore in said mounting bracket member, said body member having a screw thread on its outer circumference that engages said screw thread in the first bore of said mounting bracket member to permit rotational and longitudinal movement of said body member relative thereto, said body member further including an axial second bore that is substantially coaxial with said longitudinal axis of the mounting bracket member;

a locking member arranged to prevent relative movement between said body member and said mounting bracket member after the body member is set at a desired longitudinal position with respect to the bracket member;

a plunger supported in said bore in said body member for sliding movement relative thereto in the direction of said longitudinal axis of the mounting bracket member; and a handle pivotally mounted on the body member and having a cam portion for engaging a confronting end of said plunger, said handle being operative to drive said plunger in a first direction parallel to said longitudinal axis.

2. A clamp according to claim 1, wherein the mounting bracket member is arranged to allow linear movement of the body member in the direction of the longitudinal axis.

3. A clamp according to any claim 1, wherein the bracket member and the handle comprise metal castings.

4. A clamp according to claim 1, in which the handle cam portion surface has at least two portions of different pitch.

5. A clamp according to claim 1, in which the handle cam portion surface is in the form of an spiral eccentric cam.

6. A clamp according to claim 1, including resilient means arranged to oppose movement of the plunger in a first direction.

7. A clamp according to claim 1, wherein the plunger includes an adjustable work engaging member.

8. A clamp according to claim 1, wherein the handle includes a removable extension.

9. A clamp according to claim 7, wherein the plunger has a threaded axial bore that opens at a workpiece facing end of the plunger, and the adjustable work engaging member comprises a threaded set screw that engages the threaded bore in the plunger.

* * * * *